United States Patent [19]

Harre

[11] 4,314,770

[45] Feb. 9, 1982

[54] DETACHABLE CONNECTION ASSEMBLY FOR A PRINTING ELEMENT IN AN ELECTRIC OFFICE MACHINE

[75] Inventor: Kurt J. S. Harre, Karlshamn, Sweden

[73] Assignee: Aktiebolaget Electrolux, Stockholm, Sweden

[21] Appl. No.: 110,533

[22] Filed: Jan. 8, 1980

[30] Foreign Application Priority Data

Jan. 12, 1979 [SE] Sweden ..... 7900299

[51] Int. Cl.[3] ..... B41J 1/30

[52] U.S. Cl. ..... 400/175; 400/144.2

[58] Field of Search ..... 400/175, 144.2, 144.3; 101/93, 17

[56] References Cited

U.S. PATENT DOCUMENTS

| | | | |
|---|---|---|---|
| 1,553,765 | 9/1925 | Fischer | 400/175 |
| 3,658,162 | 4/1972 | van der Werff | 400/175 |
| 3,799,311 | 3/1974 | Guerrini et al. | 400/175 |
| 3,878,929 | 4/1975 | Orlens et al. | 400/175 |
| 3,983,985 | 10/1976 | Guerrini et al. | 400/175 |
| 3,986,593 | 10/1976 | Orlens et al. | 400/175 |
| 4,036,348 | 7/1977 | Guerrini | 400/144.2 |
| 4,161,373 | 7/1979 | Chvatlinsky | 400/175 |
| 4,202,639 | 5/1980 | Rello | 400/175 |
| 4,209,262 | 6/1980 | Savage | 101/93.17 |

FOREIGN PATENT DOCUMENTS

| | | | |
|---|---|---|---|
| 132477 | 10/1978 | German Democratic Rep. | 400/144.2 |
| 2022022 | 12/1979 | United Kingdom | 400/175 |

OTHER PUBLICATIONS

Jenkins, "Print Wheel Cartridge Assembly," Xerox Disclosure Journal, vol. 4, No. 1, p. 25, Jan./Feb. 1979.

*Primary Examiner*—William Pieprz
*Attorney, Agent, or Firm*—Alfred E. Miller

[57] ABSTRACT

An arrangement in an electric office printing machine which makes it possible, in a simple manner, to replace and safely retain a print element of a circular disc type on the motor shaft of the machine. This result is achieved by a coupling device which can be acted upon by an operating means. The coupling device is so designed that the print element attached to the end of the motor shaft is placed on a plate, included in the coupling and axially movable, after which the print element, by way of the operating means, is moved on to and fixed on the motor shaft.

13 Claims, 10 Drawing Figures

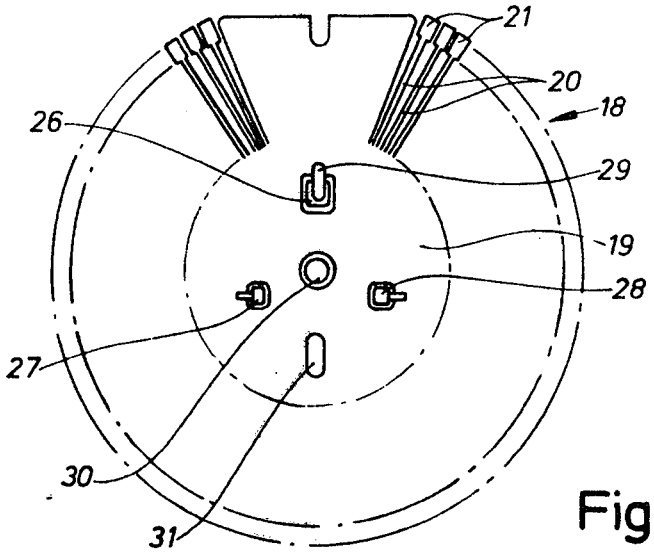
Fig. 3
Fig. 4
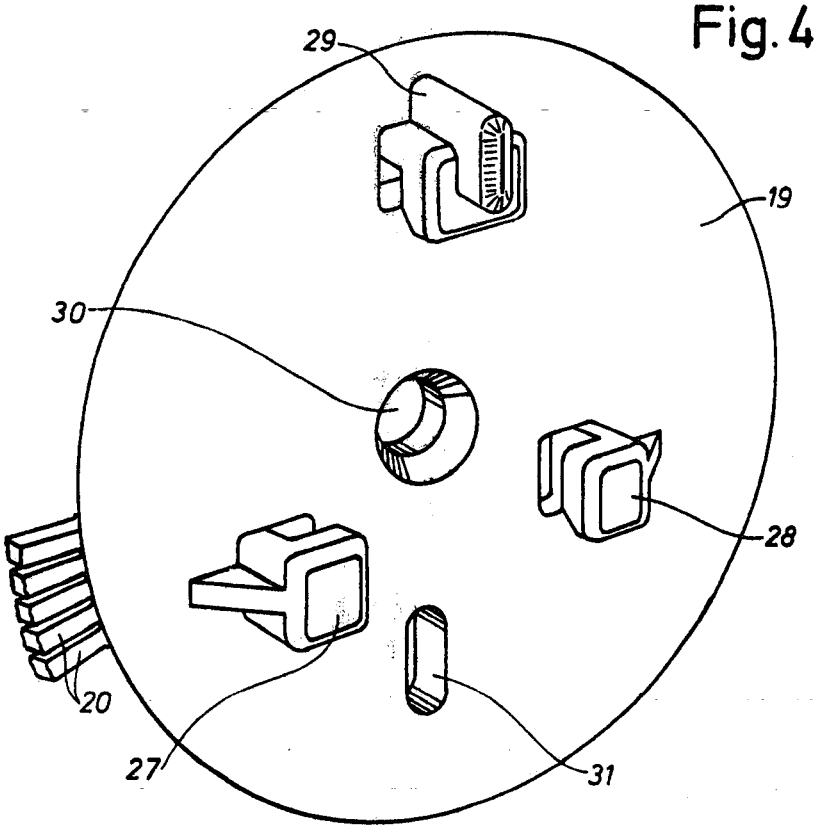

18
26
29
16
32
34
35
33
37
36
17
27
39

DETACHABLE CONNECTION ASSEMBLY FOR A PRINTING ELEMENT IN AN ELECTRIC OFFICE MACHINE

BACKGROUND OF THE INVENTION

It is known to detachably connect a print element of the present type to a motor shaft. For example U.S. Pat. Nos. 3,991,873 and 4,036,348 relate to such arrangements. The latter patent discloses an arrangement in which the print element is retained by a plurality of resilient parts to the conical end portion of the motor shaft. This arrangement has the drawback that difficulties occur when the print element is to be moved into the correct position on the shaft end, because the space between the shaft end and the platen of the typewriter is normally very limited. In practice, the printing unit with motor and print element has to be pivoted about 90° upwardly so that the print element can be inserted on the motor shaft from above.

The invention relates to a printing unit for an electric office printing machine and means for a detachable connection of the print element of the printing unit to the motor shaft.

It is an object of the present invention to provide an arrangement which makes it possible, in a simple and safe manner, to mount and retain the print element to the motor shaft, without the above-mentioned drawbacks. This object has been achieved in the arrangement according to the present invention.

The invention will now be described with reference to the accompanying drawings, in which:

FIG. 3 is a plan view of the rear side of the print element.

FIG. 4 is a perspective view of the central part of the print element on an enlarged scale.

DESCRIPTION OF THE PREFERRED EMBODIMENT

Figure 1:
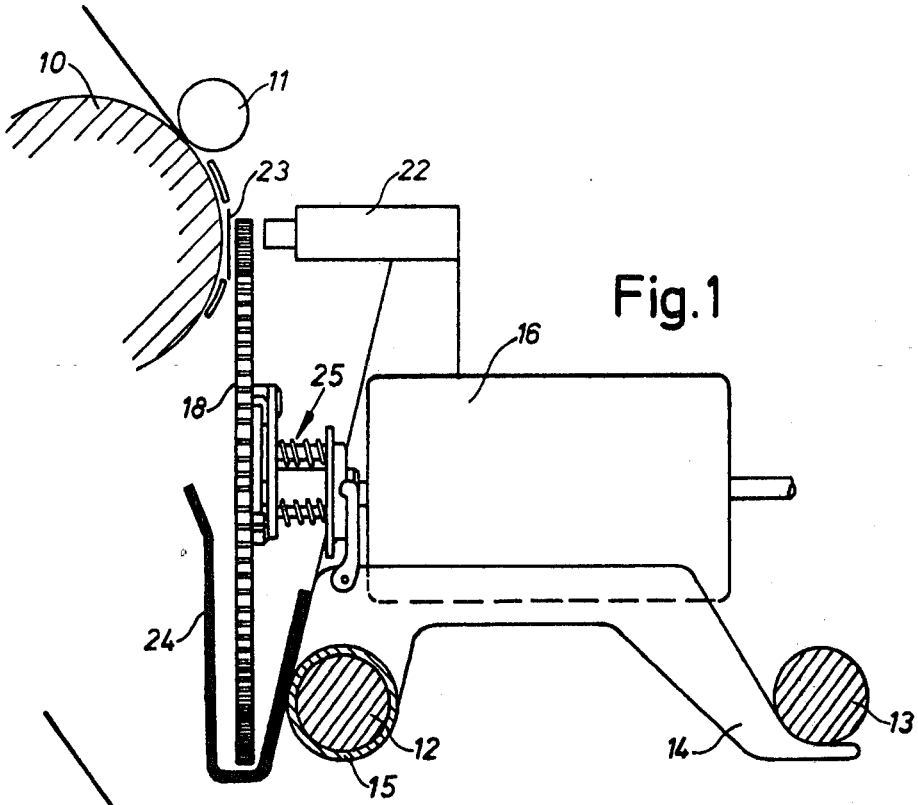
FIG. 1 is a side elevation view showing a printing position of the arrangement according to the invention.
Figure 2:
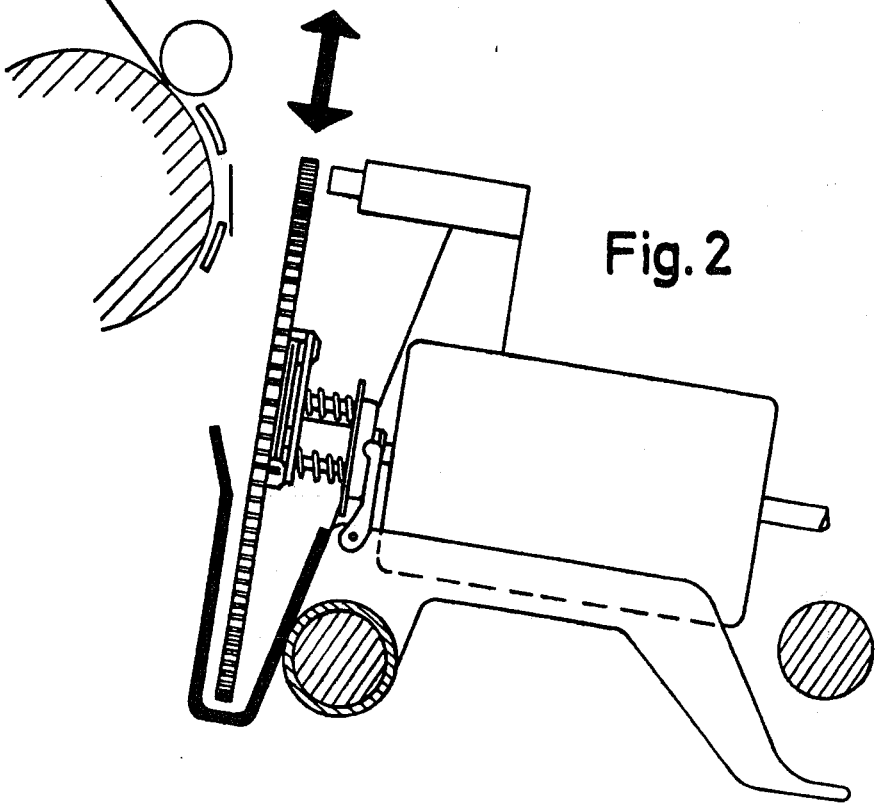
FIG. 2 is a side elevation view with the carriage pivoted and ready for mounting of the print element.

As seen in FIGS. 1 and 2, reference number 10 is a platen in an office printing machine for feeding the paper upwards. The paper is pressed to the platen by a roller 11. Mounted parallel to the platen is a front support rail 12, and a rear support rail 13 which support and guide a carriage 14. The carriage can be moved along the rails and rotated about the front support rail 12, because the lower front part of the carriage is in the form of a sleeve 15.

The carriage 14 supports a print element motor 16 having an output shaft 17 designed to be rotated to given positions which are defined by the keys on the keyboard of the office machine, or by other means. The output shaft 17 is connected to a print element 18 in the form of a circular disc 19, the outer parts of which have radially extending, resilient arms 20 of which each in its peripheral portion has one or several type characters 21.

The carriage 14 also supports a print hammer 22 disposed close to the type characters. In addition, the impact movement of the print hammer 22 is controlled in a manner not shown in detail by depressing of the keyboard key, or by other means. In conventional typewriters depression of a key thus causes a given type character to be rotated by the print element motor to its impact position, which is the upmost position in the Figures. The print hammer is then activated, and the type character strikes against a carbon ribbon 23, which in turn reproduces the character on the paper, or other media.

The carriage 14 is provided with a hood 24 fabricated of plastic or other suitable material which encloses the lower part of the print element, and is intended to retain the print element in the event it should be dropped into the machine when being exchanged.

The print element is connected to the shaft 17 by means of a fastening device, generally denoted by 25, the construction of which will be described hereinafter.

The carriage 14, together with the print element, the print element motor, and the print hammer, can be rotated or tilted from a first position (FIG. 1) to a second position (FIG. 2), in which latter position the print element 18 may be detached from the shaft 17 and exchanged. As seen in FIG. 3, the print element comprises, as described hereinabove of a circular disc 19, with arms 20 and type characters 21. The circular disc has an upper shoulder 26 and lower shoulders 27 and 28. The shoulders are hook-shaped and can engage with a plate which is positioned parallel to the disc. The upper shoulder 26 is provided with a guide 29, the object of which will appear hereinafter. The circular disc has further a circular central opening 30 with bevelled edge which is particularly designed for insertion of the shaft 17. The disc has another opening 31 which is somewhat greater than the guide 29. The opening 31 is positioned diametrically opposite the guide 29 and at the same distance from the central opening 30. The opening makes it possible, without any special spacers, to pile several print elements on each other after turning them through 180° relative to one another.

Figure 5:
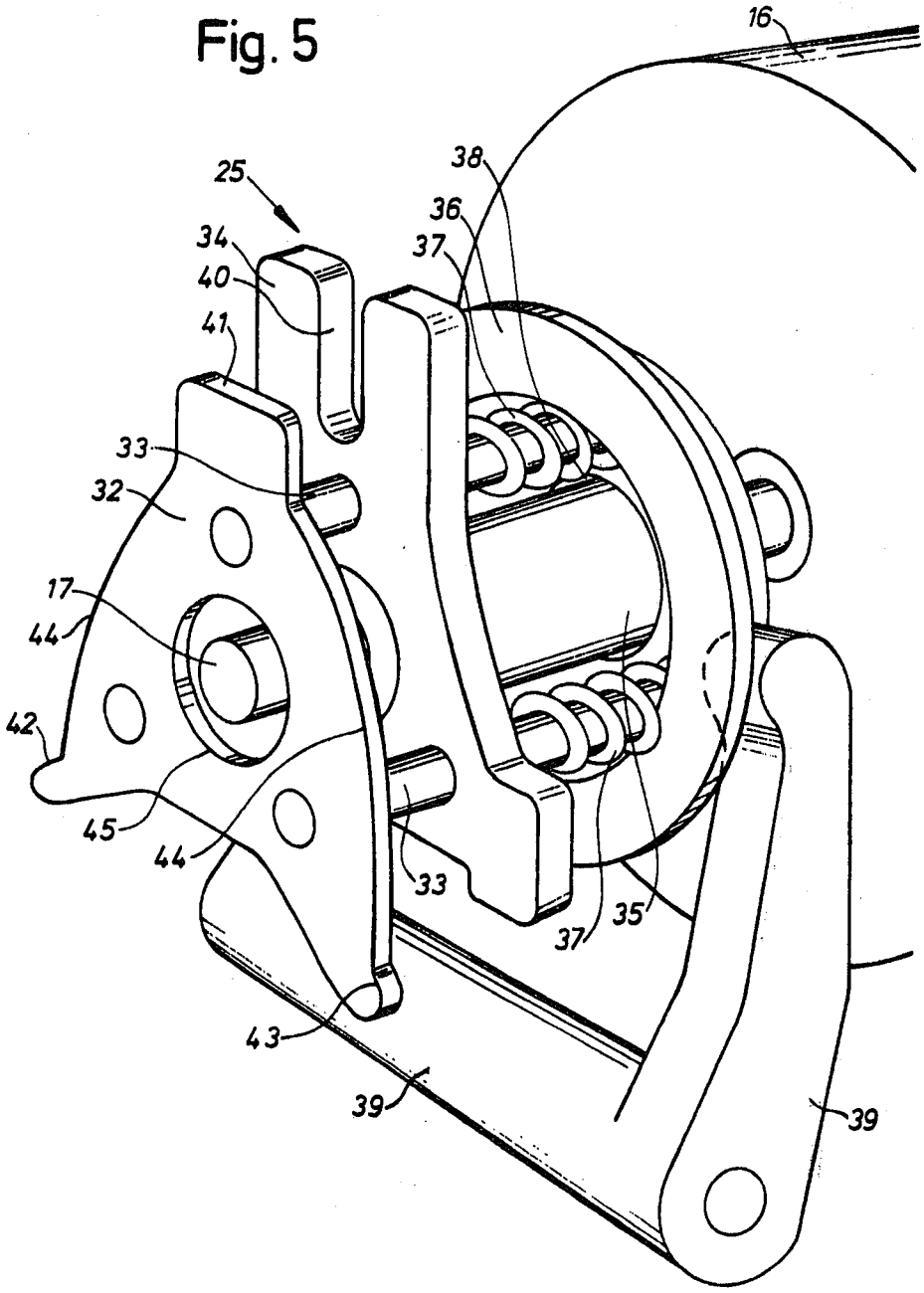
FIG. 5 is an enlarged perspective view of the fixing assembly without print element.

The fastening device 25 shown in FIG. 5 comprises a fixing plate 32 which is firmly connected to the free end of three rods 33. The rods pass through, and are guided by, holes in a dog flange 34, which is firmly connected to a dog hub 35. The other ends of the rods are connected to a pressure disc 36, so that when acted upon axially additionally causes the fixing plate 32 to move. Between the pressure disc 36 and the dog flange 34 the rods 33 are surrounded by pressure springs 37, which strive to move the fixing plate 32 in the direction towards the print element motor 16. The pressure disc 36 is provided with a central opening 38 which can be moved along the dog hub acted upon by a disengagement arm 39, which, in any suitable manner, is connected to an operating means, (not shown), that is accessible to an operator. It should be observed that also the disengagement arm 39 follows the rotating or pivoting movement of the carriage 14. The dog hub 35 is fastened to the shaft 17 with a press fit and hence follows the rotational movement of the shaft. In its upper part, the dog flange 34 has a recess or groove 40 designed to coact with the guide 29 of the print element, to thereby place the print element in the correct angular position on the shaft 17.

Figure 10:
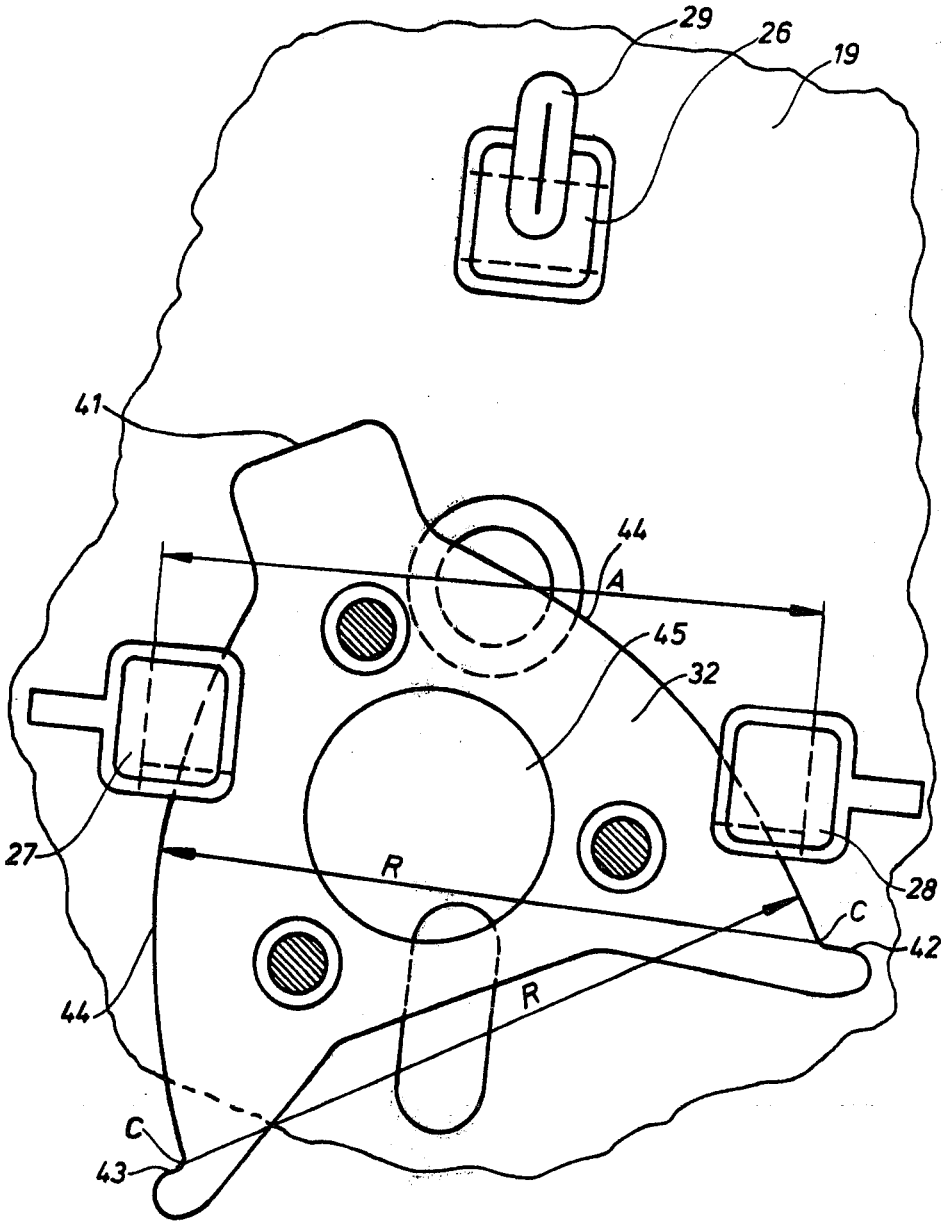
FIG. 10 is a plan view showing the principle of operation for centering the print element.

The fixing plate 32, as seen in FIG. 5, is of triangular shape, and has an upper stop 41 as well as two lower stops 42 and 43, respectively. To facilitate the mounting of the print element, the edge 44 of the plate is curved or arched in the area between the stop 41 and the stops 42 and 43. In the present embodiment the arcs form parts of circle peripheries whose centers are located at the lower stops 42 and 43, respectively. The radius of curvature R of the respective circle, as seen in FIG. 10, is somewhat less than the distance A between the engagement surfaces of the shoulders 27 and 28, respectively. However, for good function, each point of the edge must be situated on or inside the circle arc represented by the said radius of curvature. The fixing plate is further provided with a central opening 45, which surrounds the shaft 17 with a certain play.

The function of the present arrangement will now be described with reference to FIGS. 6–9.

Figure 6:
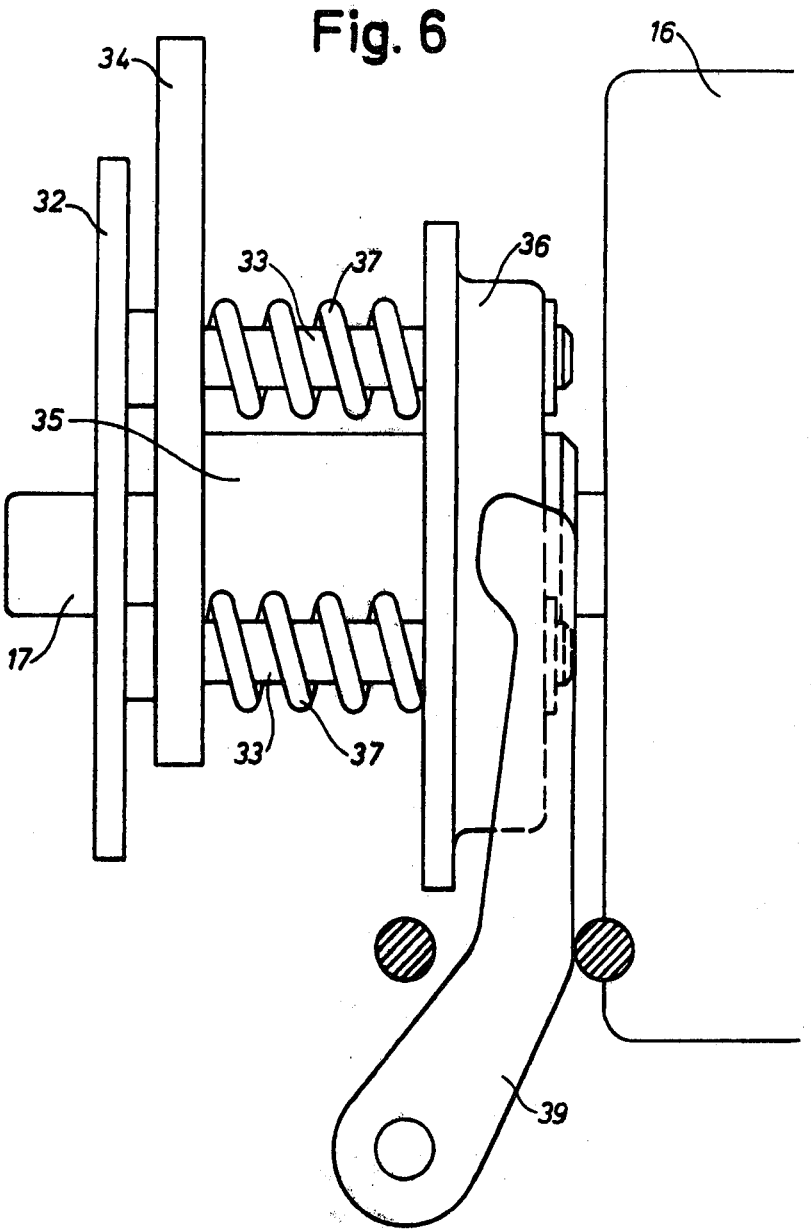
FIG. 6 is a side elevation of the fixing assembly without print element, and in an inactive position.

In the position shown in FIG. 6, it is assumed that the carriage 14 is pivoted upwards so as to be accessible for a print element to be applied. In this position the disengagement arm 39 is inoperative and thus both the pressure disc 36 and the fixing plate 32 are urged to the right in the Figure by the force of the springs 37 positioned around the rods 33. In this position the fixing plate 32 is situated slightly inwardly on the shaft 17.

Figure 7:
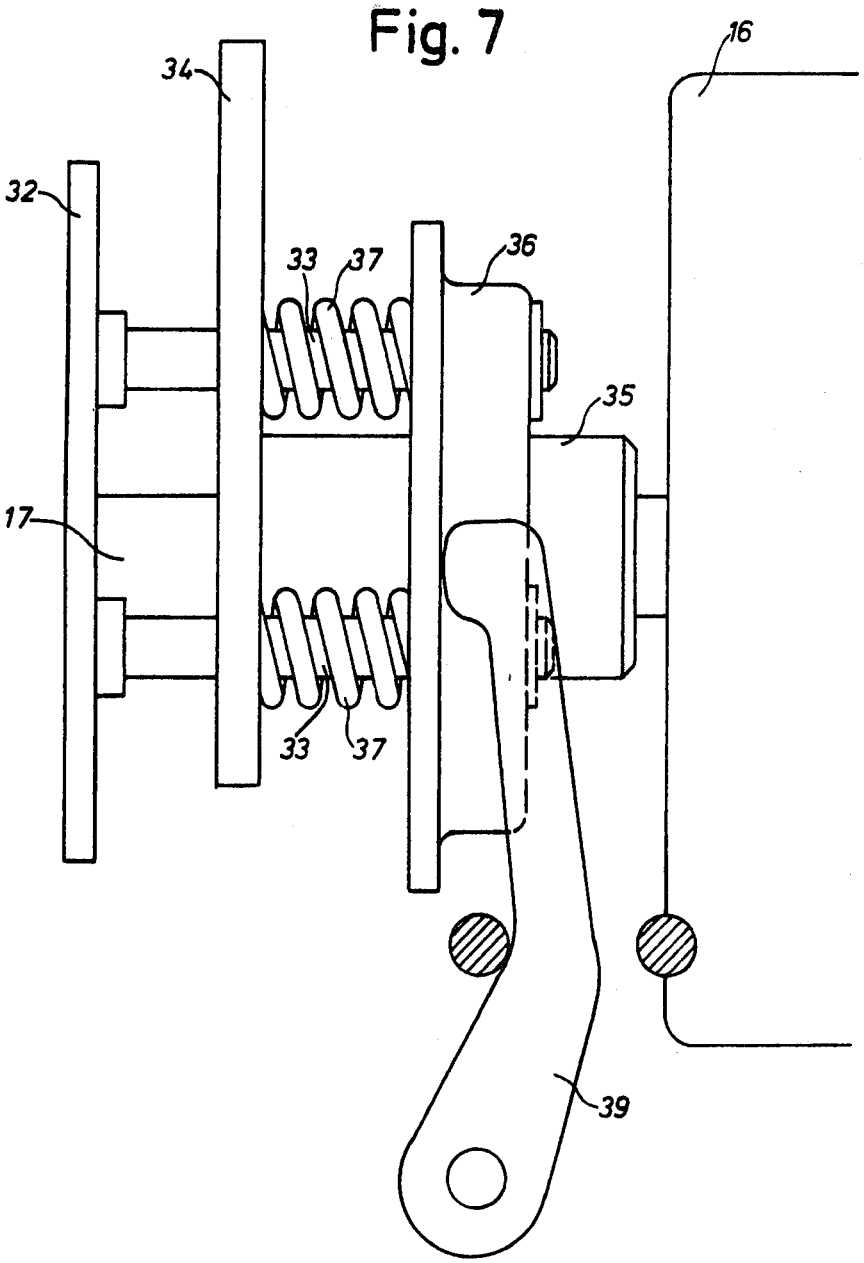
FIG. 7 is a side elevation view as FIG. 6, but with the fixing assembly in an active position.

When the disengagement arm 39 is acted upon by means of the operating means (not shown) the pressure disc 36, the rods 33 and the fixing plate 32 will be moved to the left as seen in FIG. 7, the movement being limited so that the fixing plate will be aligned with the shaft end.

Figure 8:
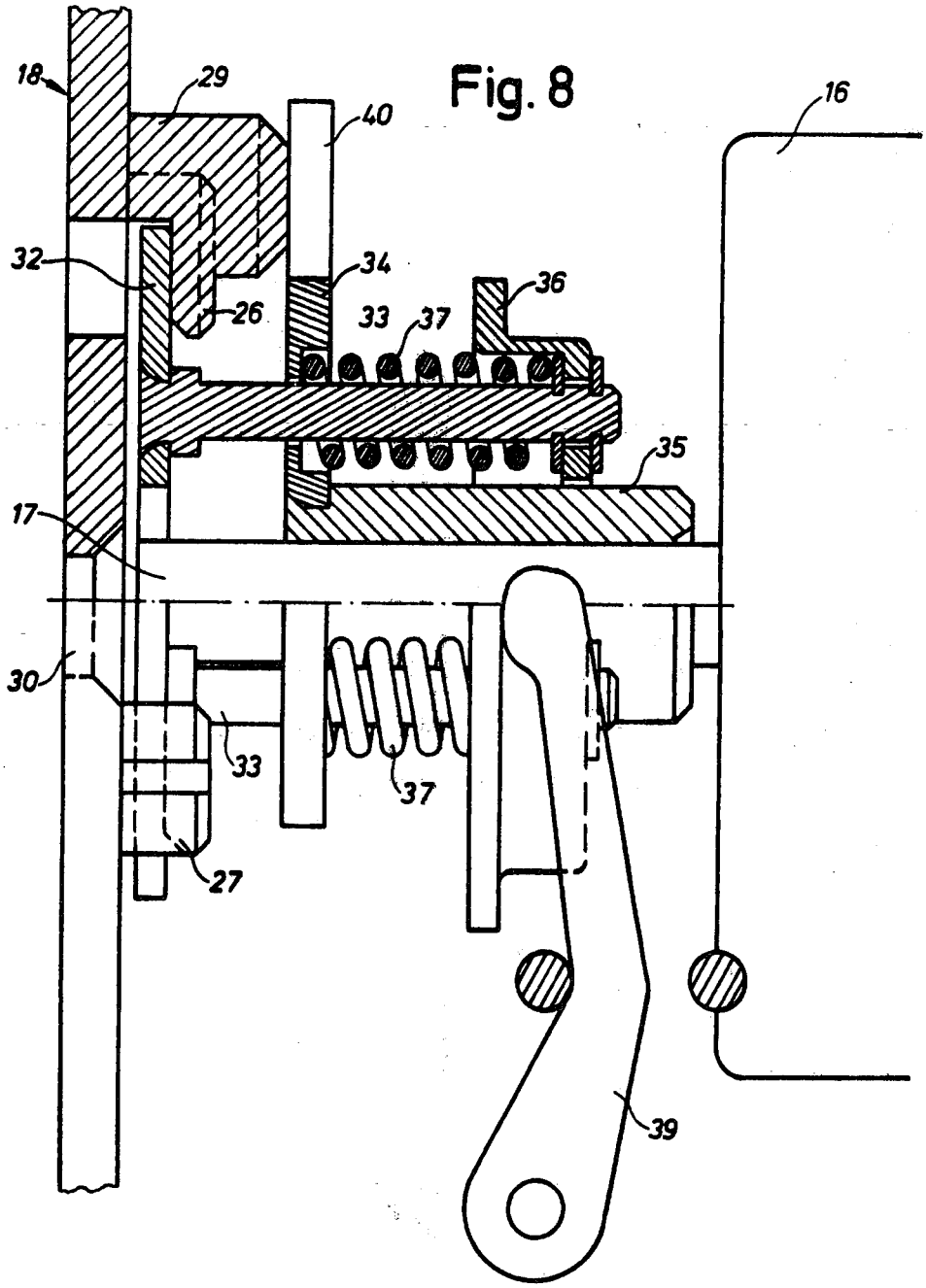
FIG. 8 shows a side elevation view as FIG. 7 with the print element ready for being locked.
Figure 9:
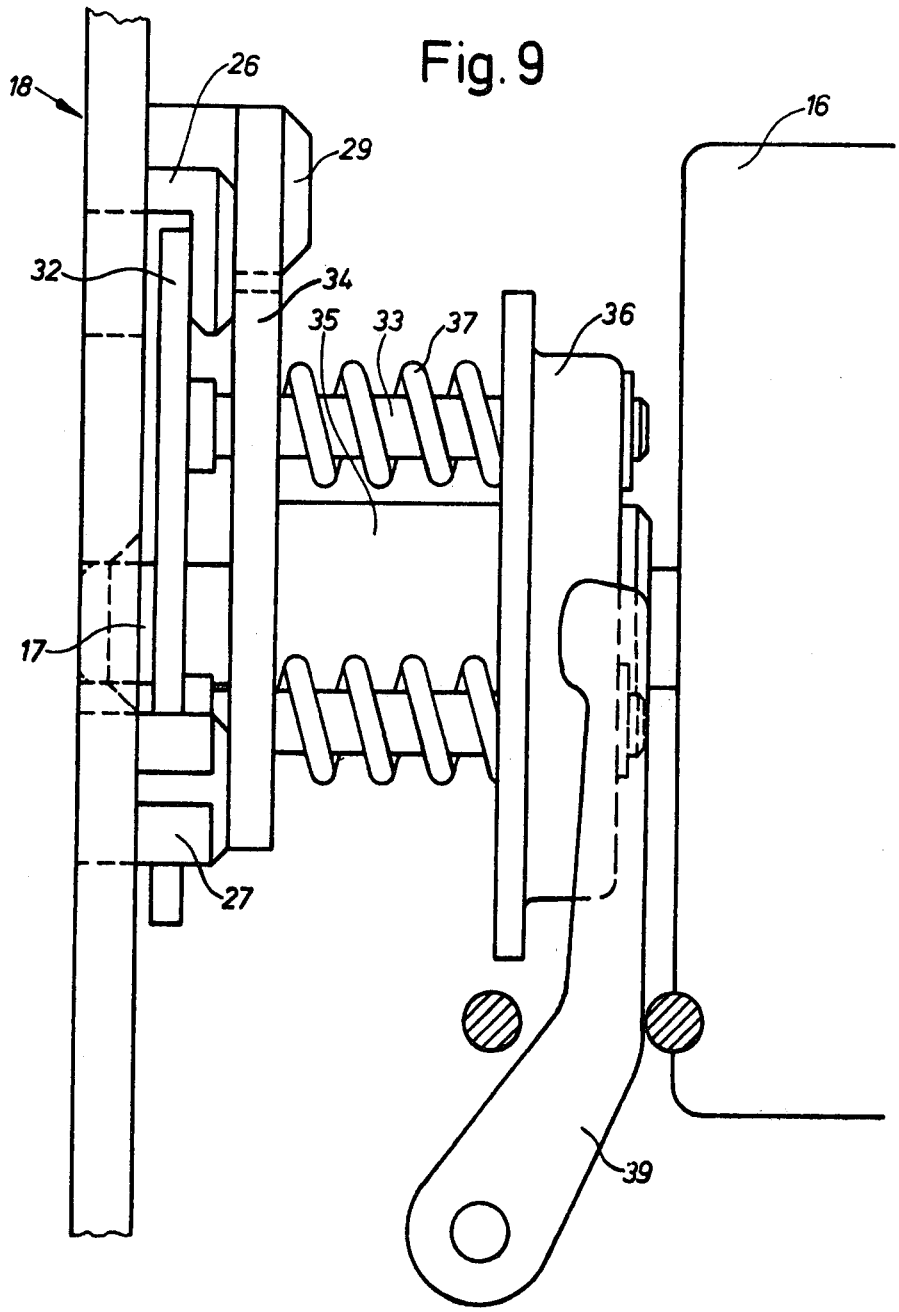
FIG. 9 is a side elevation view as FIG. 6, but with the print element being locked in place

As seen in FIG. 8, a print element can now be mounted from above with the two lower shoulders 27, 28 engaging with the edges 44 of the fixing plate and sliding along these until they reach the lower stops 42 and 43. At the same time, the upper shoulder 26 engages with the upper stop 41. In this position, the central opening 30 of the print element is situated a little below the shaft 17. When the disengagement arm 39 is released, as seen in FIG. 9, the pressure disc 36, and the fixing plate 32 with print element 18 are moved back to the right in the Figure. Thus, the guide 29 engages with the recesses 40 so that the angular position is exactly fixed at the same time as the shaft end moves into the bevelled part of the central opening 30 so that the print element is safely retained on the shaft 17. Then the carriage 14 is pivoted or rotated back to its original position, and the printing unit arrangement is ready for use.

The arrangement is self-centering in such a manner that even if the print element is applied to the fixing plate with a certain obliqueness, as shown in FIG. 10, the print element irrespective of its initial incorrect position, will come into the correct position. This is due to the fact that when one of the lower shoulders 28 reaches the lower stop 42, the print element will continue to press downwards which will cause the fixing plate to rotate or turn, so that the other shoulder 27 is urged towards the other stop 43. This, in turn, causes the upper shoulder 26 automatically to engage with the upper stop 41.

The present invention is not intended to be limited to the embodiment shown and described, but can be varied within the scope of the appended claims.

What is claimed is:

1. In an electric motor-driven office machine the improvement comprising: an assembly for detachably connecting a print element to a motor shaft, said print element being of the general shape of a circular plate having flexible, radially extending arms each of which supports a character on the extreme peripheral end thereof, a dog member rigid with the motor shaft, a fixing means rotating with said shaft for supporting the print element, an actuation means for moving the fixing means along the motor shaft between a working position in which said fixing means is situated coaxially about said motor shaft and in which the print element is connected with and centered by the motor shaft and a loading position in which the fixing means is situated outside the end of said motor shaft, said print element being provided with attachment shoulders coacting with cooperating surfaces on said fixing means to detachably return said print element on said fixing means, the print element in the working position of the fixing means being clamped between axially opposite surfaces on the fixing means and the dog member respectively.

2. An assembly as claimed in claim 1 wherein said attachment shoulders of the print element are clamped between the axially opposite surfaces on the fixing means and the dog member respectively.

3. An assembly as claimed in claim 1 further comprising a pressure disc, a plurality of rods connecting said fixing means to said pressure disc, a spring surrounding each of said rods thereby causing said fixing means to be spring loaded towards said working position, said pressure disc surrounding said motor shaft and being acted upon by said actuating means.

4. An assembly as claimed in claim 1 further comprising a flange connected to said dog member, said flange being provided with an open ended recess.

5. An assembly as claimed in claim 4 wherein said print element is provided with a guide member on the rear surface thereof coacting with said recess in the flange of said dog member.

6. An assembly as claimed in claim 1 wherein said fixing means is a plate with a central opening which surrounds said motor shaft during part of the movement of said plate.

7. An assembly as claimed in claim 6 wherein said fixing means plate is generally triangular in shape and is provided with an upper stop and two lower stops, each stop being positioned near the apices of the triangle.

8. An assembly as claimed in claim 7 wherein the edges of the fixing means plate between the upper stop and either of the two lower stops are arcuate.

9. An assembly as claimed in claim 1 wherein said print element has a central opening adapted to surround said motor shaft during part of the movement of said plate and two lower attachment shoulders and an upper attachment shoulder, said shoulders being adapted to engage said fixing plate.

10. An assembly as claimed in claim 9 wherein said fixing plate is generally triangular in shape and is provided with an upper stop and two lower stops, each stop being positioned near the apices of the triangle, the shoulders of the print element being adapted to engage the stops on the fixing plate.

11. An assembly as claimed in claim 9 wherein said print element is provided with an aperture diametrically opposite said upper attachment shoulder and at the same distance from the opening for said motor shaft, said aperture being larger than said guide member.

12. An assembly as claimed in claim 9 wherein each point of the edge of the fixing plate between said upper shoulder and the respective one of said two lower shoulders is located on or inside the segment of the circle, whose radius of curvature is less than the active distance between said two lower attachment shoulders of said print element and whose center of curvature is situated at the lower shoulder opposite to said edge.

13. An assembly for a detachable connection of a printing element of a printing unit in an electric motor-driven office machine to a motor shaft, said office machine having a platen, said print element being in the general shape of a circular plate having flexible, radially extending arms, each of said arms being adapted to have a character on the extreme peripheral end thereof, comprising: a dog member including a dog flange and a dog hub rigidly connected to one another, said member being rigidly connected to said shaft and following the movement thereof, said dog flange having a recess, a printing element fixing means mounted for rotation together with said shaft and movable axially of said shaft for mounting said print element on said shaft, said motor shaft supporting said dog member and coating with said print element fixing means, and an actuating means for moving said print element fixing means between two selected positions with respect to said shaft, said print element being provided with alignment shoulders which are arranged to coact with said fixing means to detachably retain said print element on said fixing means when the latter is in one said position outside the end of said motor shaft, and a guide member on said printing element for retention in said recess of the dog flange, said print element being axially clamped on said fixing means and said dog member when said fixing means is in its other said position some distance inwardly on said motor shaft.

* * * * *